United States Patent [19]

Matsuyama

[11] Patent Number: 4,581,328

[45] Date of Patent: Apr. 8, 1986

[54] INTERNAL LATENT IMAGE CORE/SHELL SILVER HALIDE PHOTOGRAPHIC EMULSIONS

[75] Inventor: Junichi Matsuyama, Kanagawa, Japan

[73] Assignee: Fuji Photo Film Co., Ltd., Kanagawa, Japan

[21] Appl. No.: 672,318

[22] Filed: Nov. 16, 1984

[30] Foreign Application Priority Data

Nov. 16, 1983 [JP] Japan ..... 58-215817

[51] Int. Cl.[4] ..... G03C 1/02; G03C 1/06

[52] U.S. Cl. ..... 430/567; 430/409; 430/599; 430/600; 430/603; 430/604; 430/605; 430/627; 430/630; 430/940

[58] Field of Search ..... 430/630, 600, 567, 564, 430/569, 599, 603, 604, 605, 627, 598, 940, 596, 409–411

[56] References Cited

U.S. PATENT DOCUMENTS 3,006,762 10/1961 Dersch ..... 430/600
3,850,637 11/1974 Evans ..... 430/409
4,431,730 2/1984 Urabe et al. ..... 430/600
4,431,731 2/1984 Sugimoto et al. ..... 430/600

FOREIGN PATENT DOCUMENTS 586916 10/1959 Canada ..... 430/600
632762 12/1961 Canada ..... 430/609

*Primary Examiner*—Mary F. Downey
*Attorney, Agent, or Firm*—Sughrue, Mion, Zinn, Macpeak and Seas

[57] ABSTRACT

An internal latent image core/shell silver halide photographic emulsion containing core/shell silver halide grains is disclosed, the grains comprising a silver halide core which is doped with a metal ion or chemically sensitized or is both doped with a metal ion and chemically sensitized, and a silver halide shell which covers at least a sensitivity speck of the core, wherein both added iodine ion and a polymer having a specific repeating unit described in the specification are present on the surface of the core/shell silver halide grains. The emulsion has a high sensitivity even without chemical sensitization of the surface of core/shell silver halide grains.

12 Claims, No Drawings

INTERNAL LATENT IMAGE CORE/SHELL SILVER HALIDE PHOTOGRAPHIC EMULSIONS

FIELD OF THE INVENTION

The present invention relates to internal latent image type silver halide photographic emulsions and particularly to internal latent image type high sensitive direct positive silver halide photographic emulsions having core/shell silver halide grains in which it is not necessary to chemically sensitize or chemically ripen the silver halide contained in the shell.

BACKGROUND OF THE INVENTION

In production of silver halide photographic emulsions, chemical sensitization is conventionally carried out for the purpose of increasing the intrinsic sensitivity of silver halide. Typical chemical sensitization processes, including a sulfur sensitization process, a noble metal sensitization process and a reduction sensitization process, are applied alone or in combination. These sensitization processes have been applied not only to "negative emulsions" wherein latent images are mainly formed on the surface of silver halide grains but also "internal latent image type emulsions" wherein latent images are mainly formed in the inside of silver halide grains.

The internal latent image type emulsions have been utilized as direct positive emulsions (direct reversal emulsions) for forming positive images directly, i.e., without carrying out reversal processing.

For example, U.S. Pat. No. 4,431,730 discloses a process for producing an internal latent image type core/shell emulsion useful as a direct positive emulsion. The silver halide grains are composed of a silver halide core which is doped with a metal ion or chemically sensitized or is both, and a silver halide shell which covers at least a sensitivity speck of the core (hereinafter referred to as "core/shell silver halide grains"). In this process, the surface of the silver halide grains contained in an internal latent image type emulsion is chemically sensitized under the presence of a polymer such as poly(N-vinylpyrrolidone), poly-(N-vinyloxazolidone), vinyl alcohol-N-vinylpyrrolidone copolymer or N-vinylpyrrolidone-vinyl acetate copolymer.

Further, Japanese Patent Publication No. 34213/77, corresponding to U.S. Pat. No. 3,761,276, discloses an internal latent image type emulsion useful as a direct positive emulsion. In this emulsion, the inner part of the silver halide grains contains a doping agent and the surface of the grains is chemically sensitized. Such an emulsion is also disclosed in U.S. Pat. No. 3,317,322 to Porter et al.

However, in processes for forming direct positive images using an emulsion in which the surface of internal latent image type core/shell silver halide grains is chemically sensitized, increased sensitivity of the direct positive emulsion leads to the serious disadvantage that re-reversal negative images are formed by exposure to light at a high illuminance for a short time. The re-reversal negative images caused by exposure to light at a high illuminance for a short time appear as prominent white spots on the image, in the case of exposure using a flash bulb, which spoil the quality of the photograph. Therefore, it is necessary in practical use to prevent the formation of re-reversal images as far as possible.

In order to prevent formation of re-reversal negative images caused by exposure to light at a high illuminance for a short time, the surface of internal latent image type core/shell silver halide grains should not be chemically sensitized. However, in this case the emulsion is not suitable in practical use because of its low sensitivity.

British Patent Nos. 1,151,363 and 1,195,837 disclose processes for forming direct positive images having a high maximum density ($D_{max}$) and a low minimum density ($D_{min}$) without chemical sensitization of the surface of silver halide grains by using "conversion type" internal latent image emulsions produced utilizing the solubility difference of silver halide.

The first British Patent relates to an internal latent image type silver bromide emulsion produced by slowly adding an aqueous solution of potassium bromide to a silver chloride emulsion to effect conversion of halogen, and adding an aqueous solution of potassium iodide to the resulting emulsion, and it discloses that when the resulting emulsion layer is exposed to light at a high illuminance for a short time through a step wedge and processed with a surface developer while the whole surface is exposed to light (fogging processing), direct reversal positive images are obtained which have a high $D_{max}$ as compared with emulsions without being added iodine ion. The second British Patent relates to the same process as the first British Patent, except that a hydrazine type nucleating agent (fogging agent) is used instead of exposure of the whole surface (fogging processing).

The internal latent image type "core/shell silver halide" emulsion is quite different from the "conversion type" internal latent image emulsion in that the core/shell silver halide grain has a silver halide core which is doped with a metal dopant (other than Ag) and/or chemically sensitized, and a satisfactory direct positive image is not obtained, even if a "core/shell silver halide" emulsion is developed with a surface developer after adding iodine ion and carrying out exposure of the whole surface or using a nucleating agent.

SUMMARY OF THE INVENTION

An object of the present invention is to provide inner latent image type core/shell silver halide direct positive photographic emulsions in which high sensitivity is obtained without chemical sensitization of the surface of core/shell silver halide grains.

Another object of the invention is to provide high sensitive direct positive silver halide photographic light-sensitive materials having at least one photographic layer containing such an internal latent image type core/shell silver halide emulsion.

Further objects of the present invention are to provide a process for producing the above-described photographic emulsions and a process for forming direct positive images using such photographic emulsions.

Accordingly, the above-described objects have been effectively attained by the following photographic emulsions (1) and (2) (hereinafter referred to as the first embodiment and the second embodiment, respectively, of the present invention).

(1) An internal latent image type core/shell silver halide photographic emulsion containing core/shell type silver halide grains, comprising a silver halide core which is doped with a metal ion or chemically sensitized or is both doped with a metal ion and chemially sensitized, and a silver halide shell which covers at least a sensitivity speck of the core, wherein both added iodine ions and a polymer having a repeating unit represented by the following general formula (I) are present on the surface of the core/shell type silver halide grains:

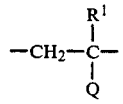

(I)

wherein $R^1$ represents a hydrogen atom or an alkyl group, and Q represents a group selected from the following general formulae (II) to (V):

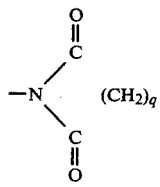

(II)

wherein q represents an integer of 2 to 4;

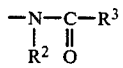

(III)

wherein $R^2$ and $R^3$, which may be the same or different, each represents a hydrogen atom or an alkyl group;

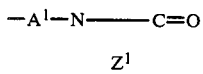

(IV)

wherein $Z^1$ represents an atomic group necessary for forming a lactam ring, an oxazolidone ring or a pyridone ring, and $A^1$ represents a single bond,

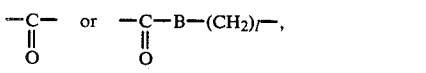

wherein B represents —O— or

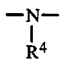

(wherein $R^4$ represents a hydrogen atom or an alkyl group) and l represents an integer of 1 to 6; and

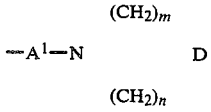

(V)

wherein $A^1$ is as defined for general formula (IV), D repesents a single bond, —O— or

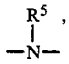

and m and n each represents an integer of 1 to 6, and (m+n) is an integer of 4 to 7, and $R^5$ represents a hydrogen atom, an alkyl group or

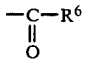

(wherein $R^6$ represents an alkyl group).

(2) An internal latent image type core/shell silver halide photographic emulsion containing core/shell type silver halide grains comprising a silver halide core which is doped with a metal ion or chemically sensitized or is both doped with a metal ion and chemically sensitized, and a silver halide shell which covers at least a sensitivity speck of the core, wherein the shell comprises mainly silver bromide, iodine ion is localized near the surface (in surface thin layer) of the shell in an amount not exceeding 0.5% by mol of silver halide of the shell, and a polymer having a repeating unit represented by the above-described general formula (I) is present on the surface thereof.

DETAILED DESCRIPTION OF THE INVENTION

The photographic emulsions of the present invention have the following remarkable characteristics:

(1) Chemical sensitization (chemical ripening) of the surface of the core/shell silver halide grains can be omitted.

(2) High sensitivity direct positive emulsions are obtained.

(3) Formation of re-reversal negative image by exposing to light at a high illuminance for a short time is eliminated or greatly reduced.

(4) Direct positive images having a high $D_{max}$ and a low $D_{min}$ (fog) are obtained.

(5) The emulsions have good stability and can be stored for a long period of time.

When the surface of core/shell silver halide grains is not chemically sensitized, direct positive images are not obtained when either iodine ion or the above-described polymer is added alone. Accordingly, it is a surprising result that cannot be understood or explained based on prior knowledge in the art, that direct reversal development occurs, if the above-described polymer is present on the surface of the core/shell silver halide grains having iodine ion is densely localized near the surface of the silver halide grains or having iodine ion is added after formation of the core/shell silver halide grains. It is believed that at least a part of the above-described polymer is adsorbed on the silver halide grains. It is also believed that at least a part of iodine ion added is exchanged for bromine ion on the surface of the grains.

In order to dope the core of core/shell silver halide grains used in the present invention with a metal ion, it is possible to provide a metal ion source such as cadmium salt, zinc salt, lead salt, thallium salt, iridium salt or a complex salt thereof, rhodium salt or a complex salt thereof or iron salt or a complex salt thereof during the formation or physical ripening of the silver halide grains of the core. The metal ion is used generally in an amount of about $10^{-6}$ mol or more per mol of silver halide. The silver halide of the core may be chemically sensitized with one or more of conventional noble metal sensitizers, sulfur sensitizers and reduction sensitizers, either in place of or together with doping with the above-described metal ion. When the silver halide of the core is subjected to noble metal sensitization and sulfur sensitization, sensitivity is particularly increased. Processes for sensitization of the silver halide of the core, whether by doping with a metal ion or chemical sensitization and a process for covering the surface of silver halide grains composing the core with a silver halide shell are known, such as, for example, those described in U.S. Pat. Nos. 3,206,316, 3,317,322, 3,367,778 (excluding the step of fogging the surface of grains) and 3,761,276.

The ratio of silver halide contained in the core to silver halide contained in the shell is not critical, but it is generally preferred to use about 2 to 8 mols of the latter per mol of the former.

The silver halide of the core and silver halide of the shell are preferred to have the same composition, but they may have a different composition, if desired. Silver halides that can be used in the core and the shell of the present invention include, for example, silver bromide, silver iodide, silver chloride, silver chlorobromide, silver bromoiodide and silver chlorobromoiodide. A preferred silver halide is composed of at least about 50% by mol of silver bromide, and the most preferred silver halide is silver bromide in both the core and the shell.

In the present invention, the core/shell silver halide grain particle size is not unduly limited. Good results are obtained using core/shell silver halide grains having an average particle size of about 0.1 to 2.0 microns, preferably about 0.2 to 1.5 microns, and particularly preferably about 0.8 to 1.2 microns.

The core/shell silver halide grains may have a regular crystal form, such as cubic or octahedral or an irregular crystal form such as spherical or tabular, or may have a mixed crystal form. They may be composed of a mixture of grains having different crystal forms.

The core/shell silver halide grains of the present invention are dispersed in a binder by known methods. Gelatin is advantageously used as a binder, although other hydrophilic colloids can be used, if desired.

For example, suitable binders include proteins such as gelatin derivatives, graft polymers of gelatin with other high polymers, albumin or casein; cellulose derivatives such as hydroxyethyl cellulose, carboxymethyl cellulose or cellulose sulfate; and saccharose derivatives such as sodium alginate or starch derivatives.

As gelatin, acid-processed gelatin and enzyme-processed gelatin described in *Bull. Soc. Sci. Photo. Japan*, No. 16, page 30 (1966) may be used, as well as lime-processed gelatin. Gelatin hydrolyzates and enzyme decomposition products can also be used. Gelatin derivatives obtained by reacting gelatin with various compounds, for example, acid halides, acid anhydrides, isocyanates, bromoacetic acid, alkanesultones, vinylsulfonamides, maleinimides, polyalkylene oxides, epoxy compounds and the like can be used, including those described in U.S. Pat. Nos. 2,614,928, 3,132,945, 3,186,846 and 3,312,553, British Patent Nos. 861,414, 1,033,189 and 1,005,784 and Japanese Patent Publication No. 26845/67.

The above-described gelatin graft polymers include products prepared by grafting a homo- or copolymer of vinyl monomers such as acrylic acid, methacrylic acid, esters and amides thereof, acrylonitrile or styrene with gelatin. Particularly, graft polymers of gelatin with a polymer having some compatibility with gelatin such as a polymer of acrylic acid, methacrylic acid, acrylamide, methacrylamide, or hydroxyalkyl methacrylate are preferred, such as those described in U.S. Pat. Nos. 2,763,625, 2,831,767 and 2,956,884.

Typical synthetic hydrophilic high molecular substances are described in, for example, West German Patent Application (OLS) No. 2,312,708, U.S. Pat. Nos. 3,620,751 and 3,879,205 and Japanese Patent Publication No. 7561/68. For the purpose of improving permeability to processing solutions, the photographic emulsion layers may contain substantially non-film-forming inactive particles (preferably polymer latexes) which do not substantially swell in aqueous slkali and which are compatible with gelatin. As the polymer latexes, latexes of acrylic acid or methacrylic acid polymers (homopolymers or copolymers) and styrene polymers (homopolymers or copolymers) can be used.

The amount of the polymer containing a repeating unit represented by the general formula (I) used in the present invention is from about 2 mg to 1,000 mg and particularly from about 2 mg to 400 mg, calculated as the weight of the repeating unit represented by general formula (I) contained in the polymer, per mol of silver, the amount varying within this general range according to the kind of the polymer used or the average particle size of core/shell silver halide used. Generally, the amount of the polymer required decreases with an increase of the average particle size of the core/shell silver halide used, and the amount of the polymer required can be selected from the above-described range when using core/shell silver halide grains having a practical particle size.

The polymers used in the present invention contain a repeating unit represented by the general formula (I). Preferred polymers are those wherein $R^1$ represents a hydrogen atom and Q represents any of the following (i) to (iii).

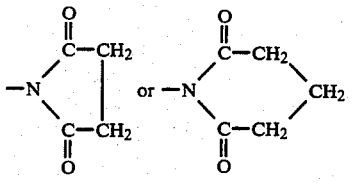

(i)

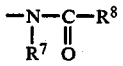

(ii)

wherein $R^7$ represents a methyl group or an ethyl group and $R^8$ represents a hydrogen atom, a methyl group or an ethyl group; and

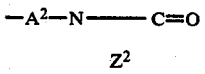

(iii)

wherein $A^2$ represents a single bond or

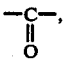

and $Z^2$ represents a 5- or 6-membered lactam ring or oxazolidone ring. It is particularly preferred that Q represent

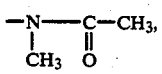

a pyrrolidone residue or an oxazolidone residue, and most preferably Q represents a pyrrolidone residue.

The polymers having a repeating unit represented by the general formula (I) may be homopolymers or copolymers.

The polymers used in the present invention may be polymers obtained by homopolymerization of a monomer represented by the following formula (IA):

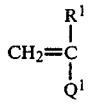

(IA)

wherein $Q^1$ represents any of the following general formulae (X) to (XIII)

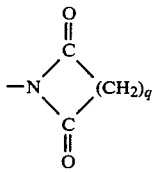

(X)

wherein q is an integer of 2 to 4;

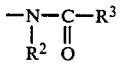

(XI)

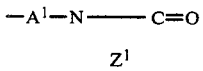

(XII)

and

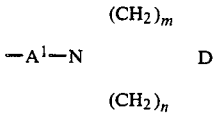

(XIII)

wherein $R^1$, $R^2$, $R^3$, $A^1$, $Z^1$ and D are each defined as for the general formula (I), by copolymerizing two or more of the above-described monomers, or by copolymerizing the above-described monomer with ethylenically unsaturated compounds capable of addition polymerizing with said monomers.

Examples of monomers represented by the general formula (IA) include N-vinylsuccinimide, N-vinylglutarimide, N-vinyladipinimide, N-vinylacetamide, N-methyl-N-vinylformamide, N-methyl-N-vinylacetamide, N-ethyl-N-vinylacetamide, N-methyl-N-vinylpropionamide, N-vinyl-pyrrolidone, N-vinylpiperidone, N-vinyl-ε-caprolactam, N-vinyloxazolidone, N-acryloylpyrrolidone, N-acryloyloxyethylpyrrolidone, N-acryloylmorpholine, N-acryloylpiperidine, N-methacryloylmorpholine, N-β-morpholinoethylacrylamide, N-vinylmorpholine and N-vinyl-2-pyridone. Of these, N-vinylsuccinimide, N-vinylglutarimide, N-methyl-N-vinylacetamide, N-ethyl-N-vinylacetamide, N-vinylpyrrolidone, N-vinylpiperidone and N-vinyloxazolidone are preferred. N-methyl-N-vinylacetamide, N-vinylpyrrolidone and N-vinyloxazolidone are particularly preferred.

Addition polymerizable ethylenically unsaturated compounds for producing copolymers together with the monomers represented by the general formula (IA) include, for example, acrylic acid esters, methacrylic acid esters, acrylamides, methacrylamides, allyl compounds, vinyl ethers, vinyl esters, vinyl heterocyclic compounds, styrenes, maleic acid esters, fumaric acid esters, itaconic acid esters, crotonic acid esters and olefins. Examples of suitable compounds include methyl acrylate, ethyl acrylate, isopropyl acrylate, n-butyl acrylate, octyl acrylate, 2-chloroethyl acrylate, 2-cyanoethyl acrylate, N-(β-dimethylaminoethyl)acrylate, benzyl acrylate, cyclohexyl acrylate, phenyl acrylate; methyl methacrylate, n-propyl methacrylate, isopropyl methacrylate, n-butyl methacrylate, cyclohexyl methacrylate, 3-sulfopropyl methacrylate; allyl butyl ether, allyl phenyl ether; methyl vinyl ether, butyl vinyl ether, methoxyethyl vinyl ether, 2-hydroxyethyl vinyl ether, (2-dimethylaminoethyl)vinyl ether, vinyl phenyl ether, vinyl chlorophenyl ether; acrylamide, methacrylamide, N-methyl acrylamide, N-(1,1-dimethyl-3-oxobutyl)acrylamide, N-(1,1-dimethyl-3-hydroxybutyl)acrylamide, N,N-dimethylacrylamide, acryloylhydrazine, N-methoxymethyl methacrylamide, N-(1,1-dimethyl-3-hydroxybutyl)methacrylamide, N-hydroxymethylacrylamide); vinylpyridine, N-vinylimidazole, N-vinylcarbazole, vinylthiophene; styrene, chloromethylstyrene, p-acetoxystyrene, p-methylstyrene; p-vinylbenzoic acid, methyl p-vinylbenzoate; crotonamide, butyl crotonate, glycerin monocrotonate; metyl vinyl ketone, phenyl vinyl ketone; ethylene, propylene, 1-butene, dicyclopentadiene, 4-methyl-1-hexene, 4,4-dimethyl-1-pentene; methyl itaconate, ethyl itaconate, diethyl itaconate; methyl sorbate, ethyl maleate, butyl maleate, dibutyl maleate, octyl maleate; ethyl fumarate, dibutyl fumarate, octyl fumarate; halogenated olefins such as vinyl chloride, vinylidene chloride or isoprene; and unsaturated nitriles such as acrylonitrile or methacrylonitrile. Two or more of them can be used together, if desired. Among others, acrylic acid, methacrylic acid, 2-hydroxyethyl acrylate, 2-methoxyethyl acrylate, sulfopropyl acrylate, acrylamide, dimethyl acrylamide, 2-acryloylamino-2-methylpropanesulfonic acid, hydroxyethyl acrylamide, methacrylamide, methyl vinyl ether, sodium styrenesulfonate, N-vinyl-3,5-dimethyltriazole and maleic acid anhydride, etc., are preferred from the viewpoint of hydrophilic properties of the polymers formed. The composition of the copolymers having the repeating unit represented by the general formula (I) is not restricted, but it is preferred that the component represented by the general formula (I) is in a range of 10 to 100 mol% and more preferably 50 to 100 mol%.

Synthesis of the polymers or copolymers having a repeating unit represented by the general formula (I) can be carried out by conventional processes described in British Patent Nos. 1,211,039 and 961,395, Japanese Patent Publication No. 29195/72, Japanese Patent Application (OPI) Nos. 76593/73, 92022/73, 21134/74 and 120634/74 (the term "OPI" as used herein refers to a "published unexamined Japanese patent application"), U.S. Pat. Nos. 3,227,672, 3,290,417, 3,262,919, 3,245,932, 2,681,897 and 3,230,275, John C. Petropoulos et al., *Official Digest,* Vol. 33, pages 719–736 (1961), and Shunsuke Murahashi et al., *Gosei Kobunshi,* Vol. 1, pages 246–290 and Vol. 3, pages 1–108 (1975). Polymerization initiators, concentration, polymerization temperature, reaction time and other conditions of polymerization can be widely and easily varied according to purposes.

For example, polymerization is generally carried out at about 20° to 180° C. and preferably about 40° to 120° C. with radical polymerization initiators in an amount of about 0.05 to 5 wt% based on the monomers to be polymerized. Suitable initiators include azobis compounds, peroxides, hydroperoxides and redox catalysts, for example, potassium persulfate, tert-butyl peroctoate, benzoyl peroxide, azobisisobutyronitrile, 2,2'-azobiscyanovaleric acid and 2,2'-azobis(2-amidinopropane hydrochloride).

The polymers having a repeating unit represented by the general formula (I) used in the present invention have a molecular weight of generally about 2,000 or more. Those having a molecular weight of about 8,000 to 700,000 are preferably used. However, these values are not critical for obtaining the effect of the present invention.

Examples of typical polymers having the repeating unit represented by the general formula (I) used in the present invention include the following, although the present invention is not to be construed as being limited thereto.

(1) Poly(N-vinylpyrrolidone)
(2) Poly(N-vinyloxazolidone)
(3) Poly(N-vinylsuccinimide)
(4) Poly(N-vinylglutarimide)
(5) Poly(N-vinylpiperidone)
(6) Poly(N-vinyl-ε-caprolactam)
(7) Poly(N-methyl-N-vinylacetamide)
(8) Poly(N-ethyl-N-vinylacetamide)
(9) Poly(N-vinylacetamide)
(10) Vinyl alcohol-N-vinylacetamide copolymer (molar ratio: 30:70)
(11) Vinyl alcohol-N-vinylpyrrolidone copolymer (molar ratio: 20:80)
(12) Vinyl alcohol-N-vinylpyrrolidone copolymer (molar ratio: 30:70)
(13) N-Vinylpyrrolidone-vinyl acetate copolymer (molar ratio: 70:30)
(14) N-Vinylpyrrolidone-2-hydroxyethyl acrylate copolymer (molar ratio: 70:30)
(15) N-Vinylpyrrolidone-acrylic acid copolymer (molar ratio: 90:10)
(16) N-Vinylpyrrolidone-N-vinyl-3,5-dimethyltriazole copolymer (molar ratio: 50:50)
(17) N-Vinylpiperidone-2-methoxyethyl acrylate copolymer (molar ratio: 70:30)
(18) N-Vinylpiperidone-methyl vinyl ether copolymer (molar ratio: 90:10)
(19) N-Vinyloxazolidone-vinyl alcohol copolymer (molar ratio: 65:35)
(20) N-Vinyloxazolidone-acrylic acid copolymer (molar ratio: 80:20)
(21) N-Vinylpyrrolidone-N-vinylpiperidone-2-hydroxyethyl acrylate copolymer (molar ratio: 40:30:30)
(22) Vinyl alcohol-vinyl acetate-N-vinyl-2-pyridone copolymer (molar ratio: 70:25:5)
(23) N-Vinylpyrrolidone-2-hydroxyethyl acrylate-vinyl acetate copolymer (molar ratio: 70:20:10)
(24) N-Vinylpyrrolidone-vinyl alcohol-vinylpropionate-sodium sytrenesulfonate copolymer (molar ratio: 40:40:5:15)
(25) N-Vinylpyrrolidone-acrylamide compolymer (molar ratio: 60:40)
(26) N-Vinylpyrrolidone-2-acrylamide-2-methylpropanesulfonic acid copolymer (molar ratio: 75:25)
(27) N-Vinylpiperidone-acrylamide copolymer (molar ratio: 60:40)
(28) N-Vinyloxazolidone-N-(2-hydroxyethyl)acrylamide copolymer (molar ratio: 70:30)
(29) N-Vinylpyrrolidone-N-vinylmorpholine-acrylamide copolymer (molar ratio: 50:20:30)
(30) N-Vinylsuccinimide-N-vinyl-ε-caprolactam-acrylamide copolymer (molar ratio: 40:20:40)
(31) N-Vinyloxazolidone-acrylamide-acrylic acid copolymer (molar ratio: 60:20:20)
(32) N-Vinylpyrrolidone-acrylamide-vinyl acetate-acrylic acid copolymer (molar ratio: 60:20:10:10)
(33) N-Vinylpyrrolidone-dimethylacrylamide copolymer (molar ratio: 70:30)

In the first embodiment of the present invention, a compound which releases iodine ions is added to the emulsion after the formation of core/shell silver grains so that iodine ions are present on the surface of the core/shell silver halide grains. As such compounds, an inorganic or organic water-soluble iodide is useful. Inorganic water-soluble iodides include salts of alkali metals (e.g., $Li^+$, $Na^+$ and $K^+$), salts of alkaline earth metals (e.g., $Mg^{2+}$, $Ca^{2+}$ and $Ba^{2+}$), salts of transition metals (e.g., $Cd^{2+}$ and $Zn^{2+}$) and ammonium salts. Organic water-soluble iodides include organic compounds having a quaternary nitrogen atom, for example, alkylated ammonium salts, pyridinium salts and derivatives thereof. The iodine ion-releasing compounds may be added to the core/shell silver halide emulsion either before, after, or simultaneously with the addition of the polymers having a repeating unit represented by the general formula (I).

The amount of iodine ion added to the photographic emulsions of the present invention is from about 0.01 to 0.5 mol, preferably about 0.05 to 0.1 mol, per mol of the core/shell silver halide.

In the second embodiment of the present invention, the amount of iodine ion localized near the surface of the shell (composed mainly of silver bromide) of core/shell silver halide grains is preferred to be in a range of about 0.05 to 0.1 mol per mol of silver halide of the shell. In order to localize iodine ions in the shell, the following process can be utilized. Namely, in the final stage of forming the shell, a solution of silver nitrate and a solution containing both potassium iodide and potassium bromide are added, or a solution of potassium iodide and a solution of potassium bromide are separately added with a solution of silver nitrate, to form the shell. The silver nitrate solution and the alkali halide solution are preferably added by a conventional controlled double jet method so as to prevent the formation of other silver halide grains instead of the formation of the surface thin layer of the shell.

Alternatively, only a solution of potassium iodide may be added after final formation of the shell.

In the first and second embodiments, the polymer of the present invention is dissolved in water or an organic solvent such as methanol and added to the core/shell silver halide emulsion, so that the polymer is present on the surface of the core/shell silver halide grains.

In the photographic emulsions of the present invention, it is not necessary to chemically sensitize the surface of the silver halide grains, but it may be chemically sensitized to certain degree, if desired. In addition, the photographic emulsions of the present invention can be spectrally sensitized with a dye such as a methine dye. Methine dyes to be used include cyanine dyes, merocyanine dyes, complex cyanine dyes, complex merocyanine dyes, holopolar cyanine dyes, hemicyanine dyes, styryl dyes, and hemioxonol dyes. Particularly useful dyes are those belonging to cyanine dyes, merocyanine dyes and complex merocyanine dyes. In these dyes, any of the nuclei conventionally used as basic heterocyclic nuclei in cyanine dyes can be used, including a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus and a pyridine nucleus; nuclei in which an alicyclic hydrocarbon ring is fused to the above-described nuclei; and nuclei in which an aromatic hydrocarbon ring is fused to the above-described nuclei, namely, an indolenine nucleus, a benzindolenine nucleus, an indole nucleus, a benzoxazole nucleus, a naphthoxazole nucleus, a benzothiazole nucleus, a napththothiazole nucleus, a benzoselenazole nucleus, a benzimidazole nucleus and a quinoline nucleus. These nuclei may be further substituted at the carbon atoms thereof.

In the merocyanine dyes and complex merocyanine dyes, 5- or 6-membered heterocyclic nuclei such as a pyrazolin-5-one nucleus, a thiohydantoin nucleus, a 2-thioxazolidin-2,4-dione nucleus, a thiazolidin-2,4-dione nucleus, a rhodanine nucleus or a thiobarbituric acid nucleus may be utilized as nuclei having a keto-methylene structure.

Useful sensitizing dyes are those described in, for example, German Patent No. 929,080, U.S. Pat. Nos. 2,231,658, 2,493,748, 2,503,776, 2,519,001, 2,912,329, 3,655,394, 3,656,959, 3,672,897 and 3,694,217, British Patent No. 1,242,588 and Japanese Patent Publication No. 14030/69.

These sensitizing dyes may be used alone or in combination. A combination of sensitizing dyes is often used, particularly for the purpose of supersensitization, as described in U.S. Pat. Nos. 2,688,545, 2,977,229, 3,397,060, 3,522,052, 3,527,641, 3,617,293, 3,628,964, 3,666,480, 3,679,428, 3,703,377, 3,769,301, 3,814,609 and 3,837,862, British Patent No. 1,344,281 and Japanese Patent Publication No. 4936/68.

The emulsions may contain dyes which do not have a spectral sensitization function or substances which do not substantially absorb visible light but which exhibit a supersensitization function, together with the sensitizing dyes. For example, they may contain aminostilbene compounds substituted by nitrogen containing heterocyclic groups (for example, those described in U.S. Pat. Nos. 2,933,390 and 3,635,721), aromatic organic acid-formaldehyde condensation products (for example, those described in U.S. Pat. No. 3,743,510), cadmium salts and azaindene compounds. The combinations described in U.S. Pat. Nos. 3,615,613, 3,615,641, 3,617,295 and 3,635,721 are particularly useful.

In order to produce direct positive photographic light-sensitive materials with the photographic emulsions of the present invention, the emulsion of the present invention is applied to a base together with other photographic layers, if desired. The amount coated is not unduly limited, but suitable direct positve images are generally obtained by coating an emulsion in such an amount that the silver content is about 40 mg to 800 mg per square foot of the base.

As bases, any conventional base, such as described in "Supports", *Product Licensing Index,* Vol. 92, p. 108 (1971), can be used.

For the purpose of increasing sensitivity, improving contrast or accelerating development, the photographic emulsions of the present invention may contain, for example, polyalkylene oxide or derivatives thereof, such as ethers, esters or amines, thioether compounds, thiomorpholines, quaternary ammonium salts, urethane derivatives, urea derivatives, imidazole derivatives and 3-pyrazolidones, such as, e.g., those described in U.S. Pat. Nos. 2,400,532, 2,423,549, 2,716,062, 3,617,280, 2,772,021 and 3,808,003.

Internal latent image type silver halide photographic emulsions of the present invention may contain anfifoggants and stabilizers, such as those described in "Antifoggants and Stabilizers", *Product Licensing Index,* Vol. 92, page 107 (1971).

There are many known antifoggants or stabilizers such as azoles, for example, benzothiazolium salts, nitroindazoles, triazoles, benzotriazoles or benzimidazoles (particularly, nitro- or halogen-substituted derivatives); heterocyclic mercapto compounds, for example, mercaptothiazoles, mercaptobenzothiazoles, mercaptobenzimidazoles, mercaptothiadiazoles, mercaptotetrazoles (particularly, 1-phenyl-5-mercaptotetrazole) or mercaptopyrimidines; the above-described heterocyclic mercapto compounds having water solubilizing groups such as a carboxyl group or a sulfo group; thioketo compounds, for example, oxazolinethione; azaindenes, for example, tetraazaindenes (particularly, 4-hydroxysubstituted (1,3,3a,7)tetraazaindenes); benzenethiosulfonic acids; or benzenesulfinic acids.

Compounds suitable as the antifoggants or stabilizers include, for example, 4-hydroxy-6-methyl-1,3,3a,7-tetraazaindene, 5-mercapto-1-phenyltetrazole and 3-methylbenzothiazole.

The photographic emulsions of the present invention can contain developing agents, such as those described in "Developing agents", *Product Licensing Index,* Vol. 92, pages 107–108 (1971).

The internal latent image type silver halide photographic emulsions of the present invention can be disperesed in colloids capable of being hardened with various organic or inorganic hardeners, including, e.g., those described in "Hardeners", *Product Licensing Index,* Vol. 92, page 108 (1971).

The photographic emulsions of the present invention can contain coating aids, such as those described in "Coating aids", *Product Licensing Index,* Vol. 92, page 108 (1971).

The photographic emulsions of the present invention can contain antistatic agents, plasticizers, matting agents, lubricants, ultraviolet ray absorbing agents, fluorescent whitening agents and air-fog preventing agents, etc.

In light-sensitive materials produced using the photographic emulsions of the present invention, the photographic emulsion layers and other hydrophilic colloid layers may contain dyes as filter dyes or for the purpose of preventing exposure, and other purposes, including those described in "Absorbing and filter dyes", *Product Licensing Index,* Vol. 92, page 109 (1971).

The photographic emulsions of the present invention are developed in the presence of a nucleating agent or are developed with uniform exposure of the emulsion to light, by which direct positive images are formed. Nucleating agents which may be used include hydrazines described in U.S. Pat. Nos. 2,588,982 and 2,563,785; hydrazides and hydrazones described in U.S. Pat. No. 3,227,552; quaternary salt compounds described in British Pat. No. 1,283,835, Japanese Patent Application (OPI) No. 69613/77 and U.S. Pat. Nos. 3,615,615, 3,719,494, 3,734,738, 4,094,683 and 4,115,122; sensitizing dyes having a nucleating substituent which has the function of fogging described in U.S. Pat. No. 3,718,470; thiourea bonded acylhydrazine compounds described in U.S. Pat. Nos. 4,030,925, 4,031,127, 4,245,037, 4,255,511, 4,266,013 and 4,276,364 and British Pat. No. 2,012,443; and acylhydrazine compounds with a thioamide ring or a heterocyclic group such as triazole or tetrazole bonded as an adsorbing group, described in U.S. Pat. Nos. 4,080,270 and 4,278,748 and British Pat. No. 2,011,391B.

It is preferred that the nucleating agent is used in such an amount that a sufficient maximum density is obtained when the photographic emulsion of the present invention is developed with a surface developer. In practice, since the amount varies according to properties of the silver halide emulsion used, chemical structure of the nucleating agent and development conditions, a suitable amount thereof may vary in a wide range, but it is generally in a range of about 0.01 g to 5 g (preferably about 0.05 g to 1 g) per liter of the developing solution when adding the nucleating agent to the developing solution. When the nucleating agent is added to the emulsion layer, a suitable amount is from about 0.1 mg to about 5 g and preferably about 0.5 mg to about 2 g, per mol of silver. If the nucleating agent is incorporated in a hydrophilic colloidal layer adjacent to the emulsion layer, it is added in the same amount as described above, based on the amount of silver contained in an equal area of the photographic emulsion layer.

The nucleating agents are preferably added to a photographic emulsion layer or an adjacent layer thereof.

The photographic emulsions of the present invention can be used for black-white photography and color photography. The photographic emulsions according to the invention can suitably be used, for example, in light-sensitive materials for photographing, light-sensitive materials for prints, light-sensitive materials for printing, X-ray sensitive materials, light-sensitive materials for microphotographs, diffusion transfer type light-sensitive materials, heat-developable light-sensitive materials, light-sensitive materials for use in a silver-dye bleach process and light-sensitive materials for movies. The photographic emulsions according to the invention are thus widely applicable in various fields.

When the photographic emulsions of the present invention are used for color light-sensitive materials, various dye image forming compounds (hereinafter referred to as "coloring materials") are used for the light-sensitive materials. The most typical coloring materials are couplers. Preferred couplers are nondiffusible couplers having a hydrophobic ballast group in the molecule. The couplers may be 4-equivalent type or 2-equivalent type to silver ion. Further, they include colored couplers having the function of color correction and couplers which release a development inhibitor upon development (the "DIR couplers"). The couplers may also form a colorless product by a coupling reaction.

As yellow forming couplers, known open chain ketomethylene couplers can be used. Of these couplers, benzoylacetanilide compounds and pivaloylacetanilide compounds are particularly useful.

As magenta forming couplers, pyrazolone compounds, indazolone compounds and cyanoacetyl compounds can be used, and pyrazolone compounds are particularly useful. Further, pyrazolotriazole compounds, pyrazoloimidazole compounds and pyrazolopyrazole compounds are also useful.

As cyan forming couplers, conventional phenol compounds and naphthol compounds can be used.

In addition, colored couplers and DIR couplers (DIR couplers which release a development inhibitor having high diffusibility) can be used together with these couplers.

The light-sensitive materials may contain compounds which release a development inhibitor upon development other than DIR couplers, including, for example, those described in U.S. Pat. Nos. 3,297,445 and 3,379,529, West German Patent Application (OLS) No. 2,417,914, and Japanese Patent Application (OPI) Nos. 15271/77 and 9116/78.

Two or more couplers may be contained in the same layer, and the same compound may be contained in two or more different layers.

The couplers are added generally in an amount of about $2\times10^{-3}$ mol to $5\times10^{-1}$ mol, and preferably about $1\times10^{-2}$ mol to $5\times10^{-1}$ mol, per mol of silver halide inthe emulsion layer.

If the photographic emulsions of the present invention are used in light-sensitive materials for the color diffusion transfer process, dye developing agents can be used as coloring materials. However, it is more advantageous to use coloring materials which are alkaline (in a developing solution) and nondiffusible (immobile) but which release a diffusible dye (or a precursor thereof) upon development. Diffusible dye releasing type coloring materials include couplers and redox compounds which release a diffusible dye, and are useful not only for the color diffusion transfer process (wet type) but also as coloring materials for the heat-developable light-sensitive materials (dry type).

Diffusible dye releasing redox compounds (hereinafter referred to as "DRR compounds") can be represented by the following general formula:

Y-Dye wherein Y represents a redox center capable of releasing a diffusible dye upon development, a ballast group for immobilizing the compound is bonded to Y, and Dye represents a dye moiety (or a precursor thereof), which may be bonded to the redox center through a linking group.

Examples of Y are described in U.S. Pat. Nos. 3,928,312, 3,993,638, 4,076,529, 4,152,153, 4,055,428, 4,053,312, 4,198,235, 4,179,291, 4,149,892, 3,844,785, 3,443,943, 3,751,406, 3,443,939, 3,443,940, 3,628,952, 3,980,479, 4,183,753, 4,142,891, 4,278,750, 4,139,379, 4,218,368, 3,421,964, 4,199,355, 4,199,354, 4,278,750, 4,135,929, 4,336,322 and 4,139,389, and Japanese Patent Application (OPI) Nos. 50736/78, 104343/76, 130122/79, 110827/78, 12642/81, 16131/81, 4043/82, 650/82, 20735/82, 69033/78 and 130927/79. The dye moiety represented by Dye include:

Yellow dyes, for example, those described in U.S. Pat. Nos. 3,597,200, 3,309,199, 4,013,633, 4,245,028, 4,156,609, 4,139,383, 4,195,992, 4,148,641, 4,148,643 and 4,336,322, Japanese Patent Application (OPI) Nos. 114930/76 and 71072/81, and *Research Disclosure*, 17630 (1978) and 16475 (1977);

Magenta dyes, for example, those described in U.S. Pat. Nos. 3,453,107, 3,544,545, 3,932,380, 3,931,144, 3,932,308, 3,954,476, 4,233,237, 4,255,509, 4,250,246, 4,142,891, 4,207,104 and 4,287,292, and Japanese Patent Application (OPI) Nos. 106727/77, 23628/78, 36804/80, 73057/81, 71060/81 and 134/80; and Cyano dyes, for example, those described in U.S. Pat. Nos. 3,482,972, 3,929,760, 4,013,635, 4,268,625, 4,171,220, 4,242,435, 4,142,891, 4,195,994, 4,147,544 and 4,148,642, British Pat. No. 1,551,138, Japanese Patent Application (OPI) Nos. 99431/79, 8827/77, 47823/78, 143323/78, 99431/79 and 71061/81, European Patent (EPC) Nos. 53,037 and 53,040, and *Research Disclosure,* 17630 (1978) and 16475 (1977).

The amount of these compounds coated is generally in a range of about $1\times10^{-4}$ to $1\times10^{-2}$ mol/m$^2$, and preferably about $2\times10^{-4}$ to $2\times10^{-2}$ mol/m$^2$.

The alkaline processing composition (developing solution) useful in the present invention may contain sodium sulfite, potassium sulfite, ascorbic acid and reductones (for example, piperidinohexose reductone) as preservatives.

The developing solution may contain, for example, sodium hydroxide, potassium hydroxide, sodium carbonate, potassium carbonate, sodium tertiary phosphate and sodium metaborate, as alkali agents and buffer agents. The amount of these agents is selected to adjust the pH of the developing solution to about 10 or more, and preferably about 12 to 14. Further, the developing solution may advantageously contain color development accelerators such as benzyl alcohol and conventional antifoggants such as benzimidazoles (e.g., 5-nitrobenzimidazole) or benzotriazoles (e.g., benzotriazole or 5-methylbenzotriazole), as agents for lowering the minimum density of direct positive images.

In order to develop the light-sensitive materials according to the present invention, various developing agents can be used, including polyhydroxybenzenes, for example, hydroquinone, 2-chlorohydroquinone, 2-methylhydroquinone, catechol and pyrogallol; aminophenols, for example, p-aminophenol, N-methyl-p-aminophenol and 2,4-diaminophenol; 3-pyrazolidones, for example, 1-phenyl-3-pyrazolidone, 4,4-dimethyl-1-phenyl-3-pyrazolidone, 4,4-dihydroxymethyl-1-phenyl-3-pyrazolidone, 4-methyl-4-hydroxymethyl-1-phenyl-3-pyrazolidone and 4-methyl-4-hydroxymethyl-1-p-tolyl-3-pyrazolidone; and ascorbic acid which can be used alone or in combination. In order to obtain dye images with dye forming couplers, aromatic primary amine developing agents, preferably p-phenylenediamine type developing agents can be used, including 4-amino-3-methyl-N,N-diethylaniline hydrochloride, N,N-diethyl-p-phenylenediamine, 3-methyl-4-amino-N-ethyl-N-$\beta$-(methanesulfonamido)ethylaniline, 3-methyl-4-amino-N-ethyl-N-($\beta$-sulfoethyl)aniline, 3-ethoxy-4-amino-N-ethyl-N-($\beta$-sulfoethyl)aniline and 4-amino-N-ethyl-N-($\beta$-hydroxyethyl)aniline. These developing agents may be incorporated in the alkaline processing composition (processing element) or may be incorporated in a suitable layer of the light-sensitive material.

When using DRR compounds as the coloring materials in the present invention, any silver halide developing agents (or electron donators) capable of causing cross-oxidation can be used. However, 3-pyrazolidones are particularly suitable.

If the photographic emulsions of the present invention are used in film units for a diffusion transfer process, it is preferred to process the emulsion with a viscous developing solution. This viscous developing solution is a liquid composition containing processing components necessary to cause development of silver halide emulsions and formation of diffusion transfer dye images, containing a solvent composed chiefly of water and, if necessary, hydrophilic solvents such as methanol or methyl cellosolve. The processing composition contains alkalis in an amount sufficient to maintain a pH capable of causing development of the emulsion layers and of neutralizing acids (for example, hydrohalogenic acids such as hydrobromic acid and carboxylic acids such as acetic acid) formed during the process of development and formation of dye images. Useful alkalis include alkali metal or alkaline earth metal salts and amines, such as lithium hydroxide, sodium hydroxide, potassium hydroxide, a calcium hydroxide dispersion, tetramethyl ammonium hydroxide, sodium carbonate, sodium tertiary phosphate and diethylamine. Preferably, caustic alkali is incorporated in an amount sufficient to provide a pH of about 12 or more (particularly 14) at room temperature. More preferably, the processing composition contains hydrophilic polymers such as high molecular weight polyvinyl alcohol, hydroxyethyl cellulose, or sodium carboxymethyl cellulose. These polymers are advantageously used in such an amount that the processing composition has a viscosity of 1 poise or more, and preferably 500 to 1,000 poises at room temperature.

It is particularly advantageous in monosheet type film units that the processing composition contains light absorbing substances such as carbon black or pH indicator dyes as light-shielding agents for preventing fogging of the silver halide emulsions by external light during or after processing, or desensitizers described in U.S. Pat. No 3,579,333. Development restrainers such as benzotriazole can also be added to the processing composition.

The above-described processing composition is preferably provided in a pressure-rupturable container as described in U.S. Pat. Nos. 2,543,181, 2,643,886, 2,653,732, 2,732,051, 3,056,491, 3,056,492 and 3,152,515.

When the photographic emulsions of the present invention are used in a color diffusion transfer process, the photographic emulsion may be applied to the same base to which an image receiving layer is applied, or may be applied to another base. Further, the silver halide photographic emulsion layers (light-sensitive element) and the image receiving layer (image receiving element) may be combined state in a film unit or may be provided as separate photographic materials. The film unit may be a single body throughout exposure, development and viewing or may be separated after development.

The invention is described in greater detail with reference to the following examples, which are not to be construed as limiting the scope of the present invention. Unless otherwise indicated, all parts, percents and ratios are by weight.

EXAMPLE 1

Preparation of Emulsion A

An aqueous solution of potassium bromide and an aqueous solution of silver nitrate were added at the same time to an aqueous solution of gelatin over about 90 minutes at 75° C. with vigorous stirring. 0.65 g of 3,4-dimethyl-1,3-thiazolin-2-thione was added to the aqueous solution before precipitation, while the pH was kept at about 6 during the precipitation step, and the pAg was kept at about 8.7. An octahedral silver bromide emulsion having an average particle size of about 0.8$\mu$ (core grain) was obtained. The silver bromide grains obtained were chemically sensitized by adding 3.4 mg of sodium thiosulfate and 3.4 mg of potassium chloroaurate per mol of silver. The resulting chemically sensitized grains were then grown in the same precipitation circumstances as those for forming core grains to finally form octahedral core/shell grains having a size of 1.2μ.

Preparation of Samples B-1 to B-16

The resulting Core/Shell Emulsion A was divided into 16 equal parts. One emulsion sample was prepared without additives (B-1). To four emulsions, only potassium iodide was added (B-2 to B-5). To eight emulsions, both potassium iodide and N-vinylpyrrolidone polymer (molecular weight: about 38,000) were added (B-6 to B-13). To the remaining three emulsions, only the polymer was added (B-14 to B-16).

To these 16 emulsions, a nucleating agent having the following structure was added in an amount of $8.5\times10^{-3}$ mol/mol of AgX, and then 3 ml of a 2% aqueous solution of sodium dodecylbenzenesulfonate as a coating aid and 30 ml of a 2% aqueous solution of a hardener having the following structure, each based on 1 mol of Ag, were added. Thereafter, the sixteen emulsions were applied to transparent bases. The resulting samples were imagewise exposed with tungsten light (1/100 second) and subjected to development processing (at 20° C. for 4 minutes) with the following surface developer, followed by fixing using the following fixing solution at 20° C. for 10 minutes and washing. Maximum densities ($D_{max}$) of the reversal images obtained are shown in Table 1.

Nucleating Agent

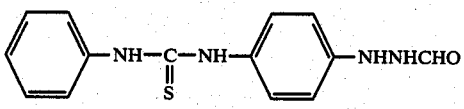

Developer

Sodium Sulfite—30 g
Hydroquinone—10 g
1-Phenyl-4-Methyl-4-Hydroxymethyl-3-Pyrazolidinone—0.75 g
Trisodium Phosphate—40 g
Sodium Hydroxide—10.7 g
5-Methylbenzotriazole—0.02 g
Water to make—1,000 ml Hardener

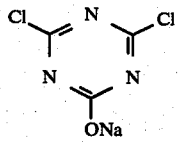

Fixing Solution

Water—600 ml
Sodium Thiosulfate—240 g
Sodium Sulfite Anhydride—15 g
Acetic Acid (28%)—48 ml
Boric Acid—7.5 g
Potash Alum—15 g
Water to make—1,000 ml

TABLE 1

| Sample No. | Additives: Potassium Iodide (mol/mol AgX) | Additives: N—Vinylpyrrolidone Polymer (g/mol AgX) | $D_{max}$ |
|---|---|---|---|
| B-1 | — | — | 0.22 |
| B-2 | $6.4\times10^{-4}$ | — | 0.22 |
| B-3 | $9.6\times10^{-4}$ | — | 0.24 |
| B-4 | $1.3\times10^{-3}$ | — | 0.30 |
| B-5 | $1.6\times10^{-3}$ | — | 0.30 |
| B-6 | $6.4\times10^{-4}$ | $2.1\times10^{-2}$ | 0.50 |
| B-7 | $9.6\times10^{-4}$ | " | 0.90 |
| B-8 | $1.3\times10^{-3}$ | " | 0.95 |
| B-9 | $1.6\times10^{-3}$ | " | 1.00 |
| B-10 | $6.4\times10^{-4}$ | $4.2\times10^{-2}$ | 1.10 |
| B-11 | $9.6\times10^{-4}$ | " | 1.43 |
| B-12 | $1.3\times10^{-3}$ | " | 1.23 |
| B-13 | $1.6\times10^{-3}$ | " | 1.15 |
| B-14 | — | $2.1\times10^{-2}$ | 0.19 |
| B-15 | — | $4.2\times10^{-2}$ | 0.20 |
| B-16 | — | $6.3\times10^{-2}$ | 0.24 |

It is understood from the results in Table 1 that in Samples B-6 to B-13 (particularly B-7 to B-13) using emulsions according to the present invention to which both potassium iodide and N-vinylpyrrolidone polymer were added, good direct reversal positive images were obtained, while in the samples having neither additive or only one of additive, images were not obtained, i.e., maximum density ($D_{max}$) is about the same as the minimum density ($D_{min}$).

Thus, by using emulsions of the present invention, good direct reversal positive images can be obtained, even if the surface of the core/shell silver halide grains is not chemically sensitized.

EXAMPLE 2

Preparation of Emulsion C (comparative emulsion)

To the Core/Shell Emulsion A were added 0.26 mg of sodium thiosulfate and 0.35 mg of potassium chloroaurate per mol of silver, and chemical sensitization of the surface of grains was carried out by heating to 60° C., to produce Comparative Emulsion C.

In the same manner, compounds of the present invention, namely, potassium iodide in an amount of $9.6\times10^{-4}$ mol/mol of AgX and N-vinylpyrrolidone polymer in an amount of 6.3 g/mol of AgX were added to Core/Shell Emulsion A to produce an emulsion according to the present invention. To these emulsions, a nucleating agent, a coating aid and a hardener were added in the same fashion as in Example 1, and the emulsions were applied to bases as in Example 1 to produce samples.

After these samples were exposed to xenon light at a high illuminance for a short time ($10^{-4}$ sec), they were subjected to development processing in the same manner as in Example 1, and reversal sensitivities and the appearance of re-reversal images* were compared.

*It is shown as an interval of exposure at which the density of the reversal image and that of the re-reversal image become ($D_{min}$+1.0). (Δ log E) The larger value of Δ log E indicates that the occurrence of the re-reversal image was more effectively prevented.

TABLE 2

| Sample | $D_{max}$ | $D_{min}$ | Reversal Sensitivity | Re-reversal Image (Δ log E) |
|---|---|---|---|---|
| Emulsion of this invention | 1.65 | 0.08 | 1.40 | 1.90 |
| Emulsion C | 1.70 | 0.08 | 1.44 | 1.51 |

It is understood from the results shown in Table 2 that the emulsion of the present invention has the advantage that the occurrence of the re-reversal image was effectively prevented, though it has the same maximum density and the same reversal sensitivity as those of Emulsion C which was subjected to surface chemical sensitization.

EXAMPLE 3

After octahedral silver bromide core grains having a size of 0.8μ were produced in the same manner as in Emulsion A, chemical sensitization processing of the core grains was carried out in the same manner as in Example 1. Then, the grains were grown under the same precipitation circumstances as in Example 1 to produce octahedral core/shell silver bromide grains having a size of 1.0μ.

The resulting emulsion was divided into six equal portions, and $4.2\times10^{-2}$ mol (per mol of silver) of a solution of silver nitrate and $4.9\times10^{-2}$ mole (per mol of silver) of a solution of potassium bromide containing quantities of potassium iodide shown in the following table were added under the same conditions as that for the formation of the shell to form an additional thin shell on the surface of grains (core/double shell).

After the N-vinylpyrrolidone polymer used in Example 1 was added in an amount of $6.3\times10^{-2}$ g/mol of AgX to these emulsions, necessary additives such as a nucleating agent and others were added in the same proportions and manner as in Example 1, and the emulsions were applied as in Example 1 to bases to produce samples. They were subjected to exposure and development processing.

TABLE 3

| Sample | Amount of $I^-$ in Double Shell* (mol) | $D_{max}$ | $D_{min}$ |
|---|---|---|---|
| 1 | 0 | 0.14 | 0.09 |
| 2 | $4.3\times10^{-4}$ | 0.15 | 0.09 |
| 3 | $8.6\times10^{-4}$ | 0.23 | 0.08 |
| 4 | $2.6\times10^{-3}$ | 0.80 | 0.08 |
| 5 | $4.3\times10^{-3}$ | 0.52 | 0.08 |
| 6 | $8.6\times10^{-3}$ | 0.22 | 0.14 |

*The amount of bromine ion contained in the added solution can be obtained by subtracting the amount of iodine ion from $4.9\times10^{-2}$ mol/Ag mol.

It is understood from the results shown in Table 3 that good reversal images can be obtained by localizing a suitable amount of iodine ion on the surface of grains as in, particularly, Examples 4 and 5 and adding N-vinylpyrrolidone polymer.

While the invention has been described in detail and with reference to specific embodiments thereof, it will be apparent to one skilled in the art that various changes and modifications can be made therein without departing from the spirit and scope thereof.

What is claimed is:

1. An internal latent image core-shell silver halide photographic emulsion containing core/shell silver halide grains, said grains comprising a silver halide core which is doped with a metal ion or chemically sensitized or is both doped with a metal ion and chemically sensitized, and a silver halide shell which covers at least a sensitivity speck of said core wherein both added iodine ion and a homopolymer or copolymer having a repeating unit represented by the following general formula (I) are present on the surface of the core/shell silver halide grains:

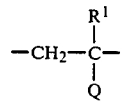

(I)

wherein $R^1$ represents a hydrogen atom or an alkyl group, and Q represents a group selected from the following general formulae (II) to (V):

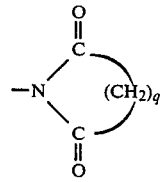

(II)

wherein q represents an integer of 2 to 4;

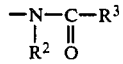

(III)

wherein $R^2$ and $R^3$, which may be the same or different, each represents a hydrogen atom or an alkyl group;

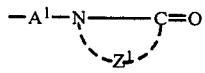

(IV)

wherein $Z^1$ represents an atomic group necessary for forming a lactam ring, an oxazolidone ring or a pyridone ring, and $A^1$ represents a single bond,

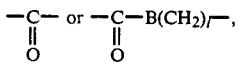

wherein B represents —O— or

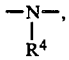

wherein R 4 represents a hydrogen atom or an alkyl group, and l represents an integer of 1 to 6; and

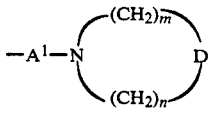

(V)

wherein $A^1$ is defined as in formula (IV), D represents a single bond, —O— or

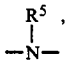

and m and n each represents an integer of 1 to 6, and (m+n) is an integer of 4 to 7, and $R^5$ represents a hydrogen atom, an alkyl group or

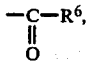

wherein $R^6$ represents an alkyl group, wherein the silver halide of said shell is not chemically sensitized.

2. An internal latent image type core/shell silver halide photographic emulsion containing core/shell type silver halide grains, said grains comprising a silver halide core which is doped with a metal ion or chemically sensitized or is both doped with a metal ion and chemically sensitized, and a silver halide shell which covers at least a sensitivity speck of the core, wherein a homopolymer or copolymer having a repeating unit represented by the following general formula (I) is present on the surface of the core/shell type silver halide grains on which iodine ion was localized near the surface, wherein said silver halide shell comprises mainly silver bromide, iodine ion is localized near the surface of said shell in an amount not exceeding 0.5% by mol of silver halide of the shell and a homopolymer or copolymer having a repeating unit represented by the following general formula (I) is present on the surface thereof:

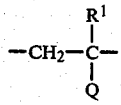

(I)

wherein $R^1$ represents a hydrogen atom or an alkyl group, and Q represents a group selected from the following general formulae (II) to (V):

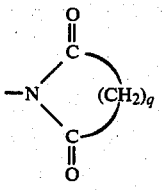

(II)

wherein q represents an integer of 2 to 4;

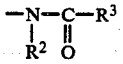

(III)

wherein $R^2$ and $R^3$, which may be the same or different, each represents a hydrogen atom or an alkyl group;

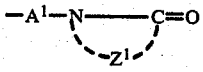

(IV)

wherein $Z^1$ represents an atomic group necessary for forming a lactam ring, an oxazolidone ring or a pyridone ring, and $A^1$ represents a single bond,

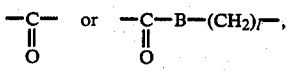

wherein B represents —O— or

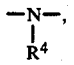

wherein $R^4$ represents a hydrogen atom or an alkyl group, and l represents an integer of 1 to 6; and

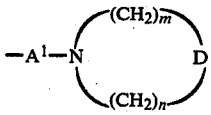

(V)

wherein $A^1$ is defined as in formula (IV), D represents a single bond, —O— or

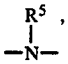

and m and n each represents an integer of 1 to 6, and (m+n) is an integer of 4 to 7, and $R^5$ represents a hydrogen atom, an alkyl group or

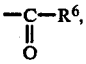

wherein $R^6$ represents an alkyl group, wherein the silver halide of said shell is not chemically sensitized.

3. The internal latent image core/shell silver halide photographic emulsion claimed in claim 1, wherein said homopolymer or copolymer is present in an amount of from about 2 mg to 1,000 mg per mol of silver, calculated as the weight of the repeating unit represented by general formula (I).

4. The internal latent image core/shell silver halide photographic emulsion claimed in claim 3, wherein said homopolymer or copolymer is present in an amount of from about 2 mg to 400 mg per mol of silver, calculated as the weight of the repeating unit represented by general formula (I).

5. The internal latent image core/shell silver halide photographic emulsion claimed in claim 1, wherein $R^1$ represents hydrogen and Q is selected from the group consisting of:

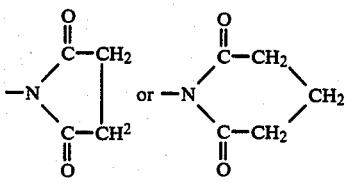

(1)

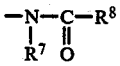

(ii)

wherein $R^7$ represents a methyl group or an ethyl group and $R^8$ represents a hydrogen atom, a methyl group or an ethyl group; and

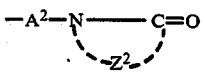

(iii)

wherein $A^2$ represents a single bond or

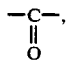

and $Z^2$ represents a 5- or 6-membered lactam ring or oxazolidone ring.

6. The internal latent image core/shell silver halide photographic emulsion claimed in claim 5, wherein Q represents

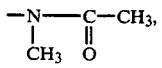

a pyrrolidone residue or an oxazolidone residue.

7. The internal latent image core/shell silver halide photographic emulsion claimed in claim 5, wherein Q represents a pyrrolidone residue.

8. The internal latent image core/shell silver halide photographic emulsion claimed in claim 2, wherein said homopolymer or copolymer is present in an amount of from about 2 mg to 1,000 mg per mol of silver, calculated as the weight of the repeating unit represented by general formula (I).

9. The internal latent image core/shell silver halide photographic emulsion claimed in claim 8, wherein said homopolymer or copolymer is present in an amount of from about 2 mg to 400 mg per mol of silver, calculated as the weight of the repeating unit represented by general formula (I).

10. The internal latent image core/shell silver halide photographic emulsion claimed in claim 2, wherein $R^1$ represents hydrogen and Q is selected from the group consisting of:

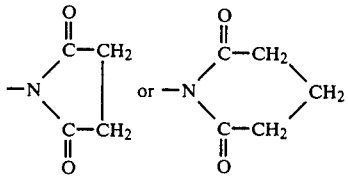

(i)

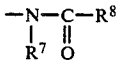

(ii)

wherein $R^7$ represents a methyl group or an ethyl group and $R^8$ represents a hydrogen atom, a methyl group or an ethyl group; and

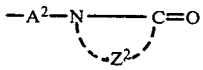

(iii)

wherein $A^2$ represents a single bond or

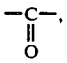

and $Z^2$ represents a 5- or 6-membered lactam ring or oxazolidone ring.

11. The internal latent image core/shell silver halide photographic emulsion claimed in claim 9, wherein Q represents

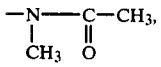

a pyrrolidone residue or an oxazolidone residue.

12. The internal latent image core/shell silver halide photographic emulsion claimed in claim 9, wherein Q represents a pyrrolidone residue.

* * * * *